US009498731B2

(12) United States Patent
Puma

(10) Patent No.: US 9,498,731 B2
(45) Date of Patent: Nov. 22, 2016

(54) MODEL CAR WEIGHT SYSTEM

(71) Applicant: Joseph Puma, Long Island City, NY (US)

(72) Inventor: Joseph Puma, Long Island City, NY (US)

( * ) Notice: Subject to any disclaimer, the term of this patent is extended or adjusted under 35 U.S.C. 154(b) by 0 days.

(21) Appl. No.: 14/972,417

(22) Filed: Dec. 17, 2015

(65) Prior Publication Data

US 2016/0175726 A1 Jun. 23, 2016

Related U.S. Application Data

(60) Provisional application No. 62/094,468, filed on Dec. 19, 2014.

(51) Int. Cl.
*A63H 15/00* (2006.01)
*A63H 17/26* (2006.01)

(52) U.S. Cl.
CPC ..... *A63H 17/262* (2013.01); *A63H 15/00* (2013.01)

(58) Field of Classification Search
CPC .. A63H 17/00; A63H 17/008; A63H 17/262; F16F 15/363
USPC ..... 446/6, 68, 465, 468, 469, 470; 301/5.22
See application file for complete search history.

(56) References Cited

U.S. PATENT DOCUMENTS

| | | | | | |
|---|---|---|---|---|---|
| 3,427,077 | A * | 2/1969 | Whitlock | F16F 15/363 | 301/5.22 |
| 3,724,904 | A * | 4/1973 | Nixon | F16F 15/363 | 301/5.22 |
| 5,460,017 | A * | 10/1995 | Taylor | D06F 37/225 | 210/144 |
| 8,011,737 | B2 * | 9/2011 | Wang | A63H 17/262 | 301/5.22 |
| 8,057,277 | B2 * | 11/2011 | Sip | A63H 17/262 | 446/431 |
| 8,083,565 | B1 * | 12/2011 | Fulton | A63H 17/262 | 446/469 |
| 2007/0238390 | A1 * | 10/2007 | Kelderhouse | A63H 17/262 | 446/469 |
| 2011/0263181 | A1 * | 10/2011 | Kreidler | A63H 17/008 | 446/470 |

* cited by examiner

*Primary Examiner* — Kien Nguyen
(74) *Attorney, Agent, or Firm* — Baker and Rannells, PA

(57) ABSTRACT

The present invention is for a system of adding weight to a gravity powered car in which the weight fits within the wheel void of a plastic, injection molded wheel commonly used for Pinewood Derby Cars, or other gravity powered cars. The weight may be made from materials not limited to tungsten, lead, steel, brass, ceramic, glass, or plastic, etc. The invention is to use the space within the wheel void for the purpose of placing weight. This is done by affixing said weight to the body of the car by means not limited to adhesives or fasteners such as bolts, screws, nails, staples and the like. The weight occupies the space within the void of the rear wheels. Cantilevered off the body of the car, these side-weights never touch the wheels or axles of the car.

7 Claims, 5 Drawing Sheets

MODEL CAR WEIGHT SYSTEM

REFERENCE TO RELATED APPLICATIONS

This application claims priority from U.S. Provisional Application Ser. No. 62/094,268, filed Dec. 19, 2014, entitled "Model Car Weight System" the application of which is incorporated by reference herein in its entirety.

I. BACKGROUND

A. Field of Invention

The present invention is in the field of gravity powered model cars, more particularly, new ways to increase and or distribute weight for the purpose of enhancing the cars performance.

B. Description of the Related Art

Pinewood Derby type cars are well-known to be used for teaching craft and social skills to various people, including but not limited to youth groups. In a typical youth group scenario challenge, a couple consisting of a child and adult are provided with a kit that contains a block of wood measuring about 1.75 in×7 in×1.25 in, four (4) plastic injection molded wheels having about 1.18 in diameter, and four (4) nails and or fasteners to be used as axles. In practice, the couple is challenged to fashion and or carve the block of wood into a body of a car and adorn it for a gravity powered race down a track, against the other like competitors. The track starts about 48 in off the ground at a decline of about 27 degrees. The track will typically have a curved transition after which it will run flat for about 35 ft.

The rules that control the aforementioned challenge typically requires the overall weight of a car to be equal to or less than about 5 oz. As a result, during the process of building a car, dense material is sometimes used to achieve maximum speed of a car, based on the maximum weight allowed. In particular, the addition of weight such as in the form of tungsten, lead, steel, zinc, glass, ceramic, plastic and or like material of varying densities, increases the potential energy of the car.

It is well-known that the further back on the car the weight is placed, the more potential energy is available. As a result, builders aiming to give their car the maximum amount of potential energy will typically place weight behind the rear axles. In order to off-set any instability as a result of said weight, additional weight is also added in front of the rear axles, which, for example, prevents a car from oscillating side to side down the track. In this sense, a well-built car according to what is currently known and as subject to the aforementioned restrictions, will typically have about 2 oz of additional weight in the form of cubes behind the rear axles and 2 oz in front of the rear axles. All in all, a total of about 24 cubes of additional weight (of about 0.16 oz each) sit in cavities about the rear axles—cavities of which the builder has carved into the body of the car.

While the current known distribution of weight allows for a stable car that preserves energy, the setup does not allow a car to maximize its potential based on the aspects of the model which can be utilized. Accordingly, there is a need in the art of Pinewood Derby type cars to introduce a new weight distribution system that provides for maximum potential.

II. SUMMARY

The present invention is a new weight distribution system that consists of a weight which is shaped and designed to fit within a wheel void. The weight may be made from any material shaped and sized to fit within said void, and for purposes of this invention includes those materials not limited to tungsten, lead, steel, brass, ceramic, glass, or plastic as these are capable of fitting within the void and provide a suitable weight. Because the weight is contained within a void about the side of the car body, the weight is referred to herein as a side-weight. According to the disclosure herein, the weight does not touch the interior of the wheel, but is affixed to the body of the car.

Each side-weight may be directly connected and or affixed to the side of the car body by means that include an adhesive, screws, staples and the like. An alignment tool is used when affixing the weight to the car body to ensure that there is clearance between the inner hub and the weight, as well as the under tread and the weight. This will allow the wheel to spin freely around the weight in a normal manner and not contact with the weight.

As discussed herein, the invention utilizes the space available within the wheel (that is of a similar form and style as wheels currently being used by the Boy Scouts of America, or other plastic wheels used for gravity races) for the purpose of maximizing the placement and effectiveness of the additional weight allowance. As to be shown in this disclosure, the inventor has discovered that the weight distribution maximizes the potential of the car and improves stability thereof.

Builders have avoided using the space inside the wheel void of these injection molded wheels for at least two reasons:

- It was commonly thought that the current practice of adding weight as close to the centerline of a car preserve more energy than adding weight on the side of the car (as this would destabilize the car as it gained momentum because side-weights far from the centerline increase rotational moment from side to side).
- Another reason that side-weights have not been developed before is that it would require considerable skill to create a weight and a means of aligning this type of weight so that it would fit inside the void while not contacting or dragging on any part of the wheel when rotating, albeit the inside of the wheel and or any portion thereof that faces the car.

Additionally, it has been discovered that by filling the void, aerodynamics of the car is improved by preventing lag which was caused by air entering the void when the car is moving. The air passing by the wheel is prevented from entering the wheel void and dragging on the wheel.

Using the side weighting system in conjunction with tungsten cubes and traditional weight cavities it is possible to add more weight behind the rear axle line of a gravity powered car than is possible without side-weights. Without using the space within the wheel voids for weight, there is not enough physical space without adding to the car's frontal profile of the car.

The reason that expert builders typically place 2 oz of tungsten behind the rear axle line of a car is because that is all the weight that can physically fit in that space without drawbacks occurring in preserving that energy. If the builder stacks tungsten higher than the height of the 0.25 in tungsten cubes behind the rear axles in an effort to increase the potential energy, then the additional aerodynamic drag created by increasing the frontal profile of the car will cost energy. If the builder moves the rear wheels forward to create more space to fit greater than 2 oz of tungsten with a thin frontal profile, then this will spread the weight out over a greater distance forward to back on the car. While this setup will keep the aero profile thin and keep the aerodynamic drag low, the weight spread in this manner increases the rotational moment of the car at the transition of the track which costs energy.

Using side weights as disclosed herein, a builder has the improved ability to fit 3.5 oz of tungsten (or other weighted material) behind the rear axle line of a gravity powered car, while having a ¼ in frontal profile on the body, and the wheels as far back on the car as possible, simultaneously making the car more aerodynamic. Side weights allow for more preservable potential energy than the other currently known weighting systems.

The side-weighting system focuses much of the car's mass directly around the rear axles. This allows a gravity powered car to lose less energy through the transition of a track because the car has a decreased rotational moment from front to back of the car over a car that spreads the weight forward of the cavities.

Side-weights allow a builder to fit up to 2.6 oz of weight within the wheel void of an injection molded wheel leaving only 1.4 oz to fit within the traditional cavities that are normally carved into a car body and used to hold 4 oz of weight. Side-weights allow the builder more design freedom as these cavities can now be made smaller, avoided, or used to shift weight in an effort to bias the car's weight from left to right.

The side-weights will also be useful for builders of moderate skill as the traditional weight cavities will not need to be made so delicate, or not made at all if the car body is made heavier than an expert would build it. In some cases the inexperienced builder may only need to add 3 oz of weight in order to bring the car up to the maximum allowable weight of 5 oz. In this case the side-weights may be the only weight that needs to be added to the car and so it will not be necessary to carve cavities or add weight in any other manner.

The builder of a gravity powered car will often want to tune their car by shifting small amounts of weight from left to right, or in front of or behind the axle line. Doing this allows the builder to figure out the best balance between maximizing the potential energy of the car (shifting weight behind the axle line), and creating a more stable, energy preserving car (shifting weight in front of the rear axle line).

During a tuning session this same shifting of weight takes place from left to right on the car. By utilizing the side weight system a builder has much more space left available to shift the remaining weight needed to bring the car up to the 5 oz maximum weight, without adding to the frontal profile of the car.

An embodiment of the side weighting system is in a donut shape with an outer diameter of 0.98 in and an inner diameter of 0.32 in. This donut shape will be approximately 0.2 in thick and made of tungsten for example, but other weighted materials are within the scope provided herein. In an embodiment, a recess may be cut into the lower hemisphere of this weight so that the weight will not drag on the guide rail (a common part on many gravity powered race tracks). As a result, the donut shape uses the maximum space allowed within the wheel void (while maintaining clearance on the under tread and the inner hub) and also blocking off the maximum amount of the wheel void from the potential for aerodynamic drag.

Another embodiment of the side weight would require some of the interior of the wheel to be visible. Prior to racing a car in a competition the car will have to pass inspection by judges. Some contests require that writing on the inside face of the wheel be visible before the car is allowed to race. A slot or viewing window will be required in the weight in order to race in these events. This slot or window will allow the judge to spin the wheel until the writing inside the wheel void is clearly visible. Accordingly a crescent or horseshoe shaped weighted material may be used for a side weight to fulfill these requirements.

III. BRIEF DESCRIPTION OF THE DRAWINGS

The invention may take physical form in certain parts and arrangement of parts, some embodiments of which will be described in the specification and illustrated in accompanying drawings which form a part hereof, wherein, when referring to the drawings, the inventor identifies the following components thereto, FIG. 1*a* is an exploded view showing how a side weight and an injection molded wheel.

FIG. 1*b* is a perspective view showing a side-weight within a wheel void

IV. DETAILED DESCRIPTION OF THE INVENTION

Figure 1A:
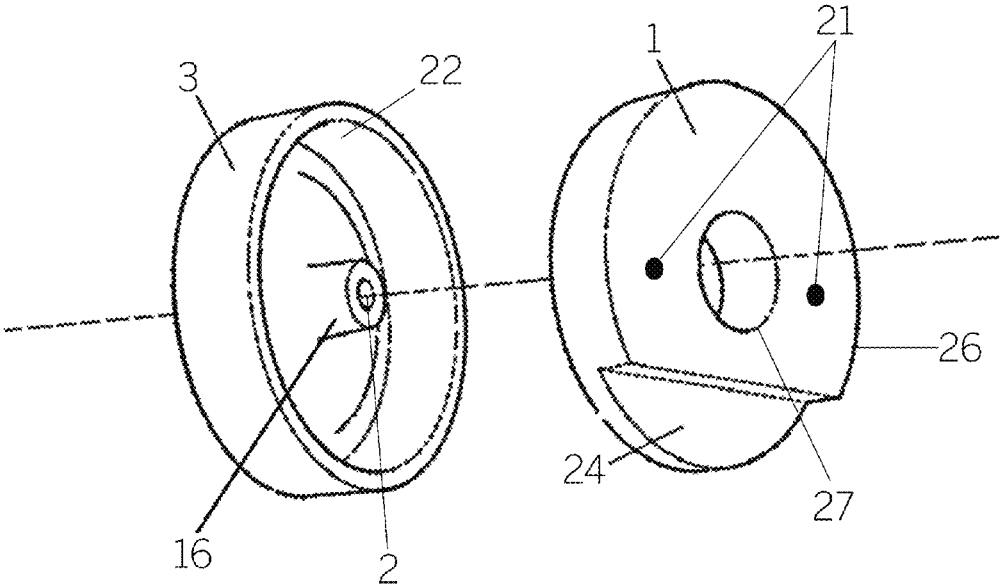
Figure 4:
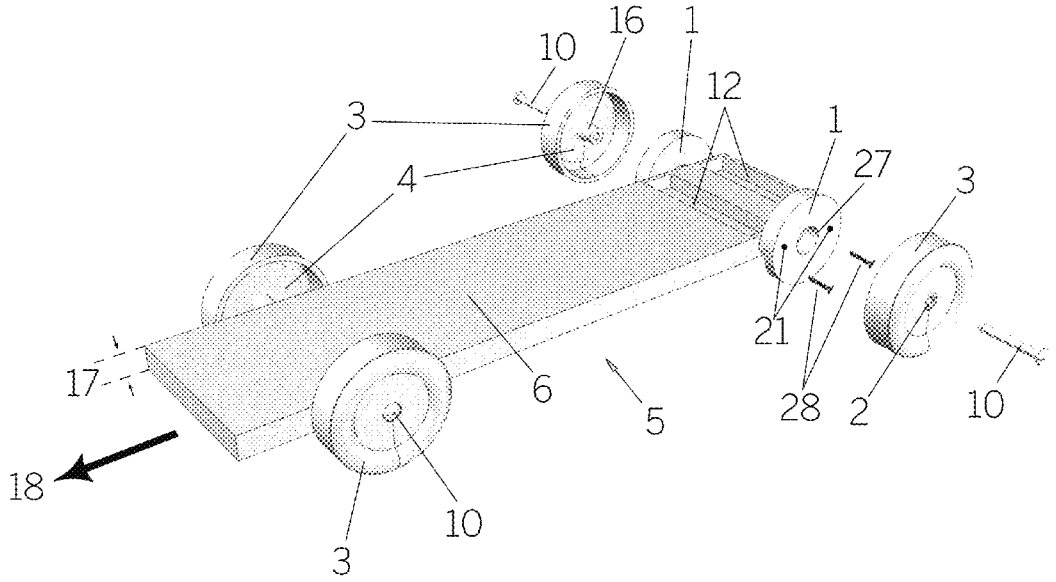
FIG. 4 is an exploded view of a gravity powered model car showing side-weights affixed to the body of said car according to the instant invention.
Figure 5:
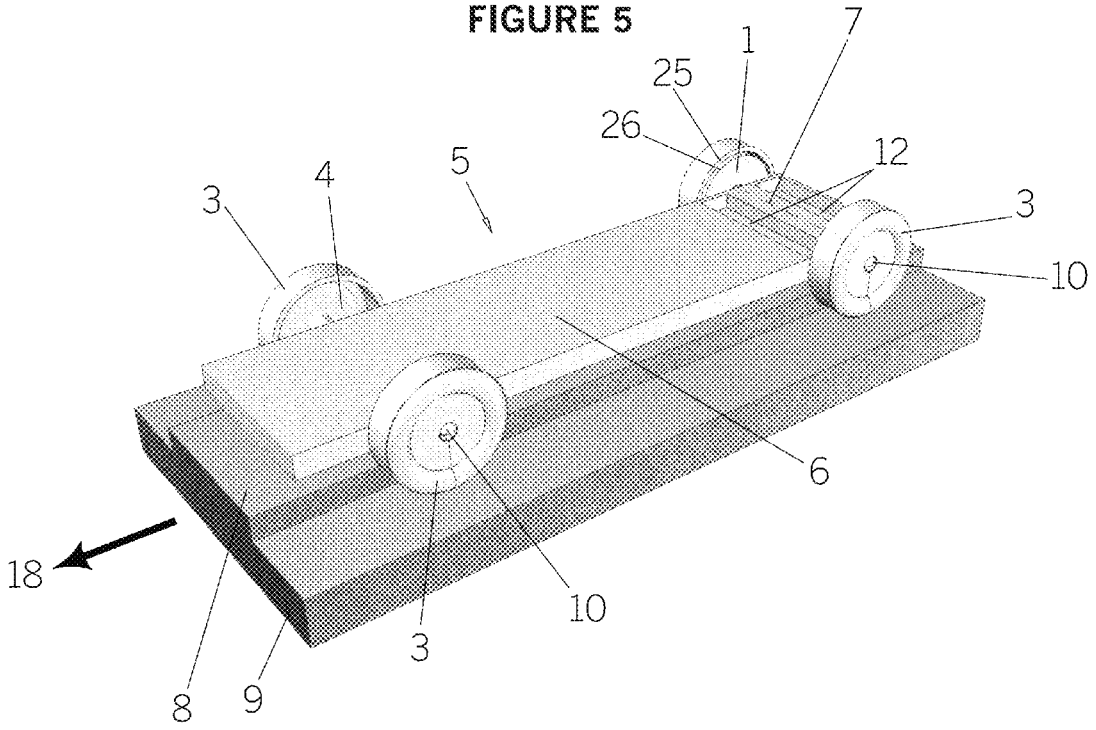
FIG. 5 is a perspective view showing a fully assembled gravity powered model car with side-weights attached sitting on a Pinewood Derby track.

FIG. 1*a* is an exploded view showing how a side-weight 1 according to the instant invention fits within a void 4 obviated within a typical injection molded model car wheel 3 when connected to a car body 6. The figure also shows wheel bore 2 which the axle 10 is inserted through to connect the wheel to the car body 6. Mounting holes 21 are shown in this embodiment of the weight 1. These holes will go clear through the weight so that screws or bolts 28 may be used to affix the weight 1 to the side of a body of a gravity powered car 6 as shown in FIG. 4. Using an alignment tool to aid in attaching the side-weight 1 to the body 6 one can have sufficient clearance between the under tread 22 and the side-weights outer edge and or diameter 26. There also needs to be clearance between the inner hub 16 and the inner diameter 27 of the side-weight 1. A recess 24 is shown in this embodiment of the side-weight 1. This recess 24 on the lower hemisphere of the weight 1 ensures that the lower hemisphere of the side-weight fits entirely inside the wheel void 4 thereby ensuring that the side-weight 1 will not drag on a guide rail 8 (as shown in FIG. 5) which are common on many gravity powered race tracks 9.

Figure 1B:
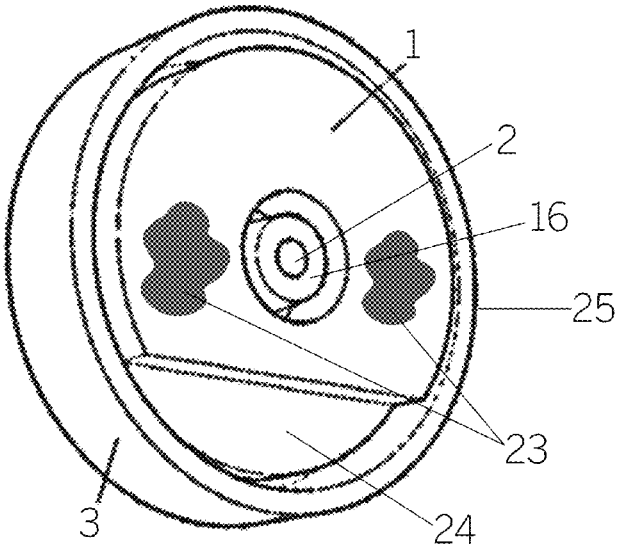

FIG. 1*b* shows an embodiment of how a side-weight 1 may be disposed in a void 4. The shape of the weight is not limited to circular as shown in FIG. 1*a* and is considered within the scope of the invention for the weight to be sized for example as a horseshoe, an octagon, or other for reasons as disclosed herein. As disclosed an adhesive 23 can be used as a method of attaching the side-weight 1 directly to the body 6 of a gravity powered car 5. FIG. 1*b* further shows how the lower hemisphere of the weight 1 is recessed and or etched 24 so that it does not protrude beyond the inner edge 25 of the wheel. This drawing also shows that there is clearance between the outer diameter and or edge 26 of weight 1 and the under tread 22, and the weight 1 inner diameter 27 does not touch the inner hub 16 of wheel 3.

Figure 2:
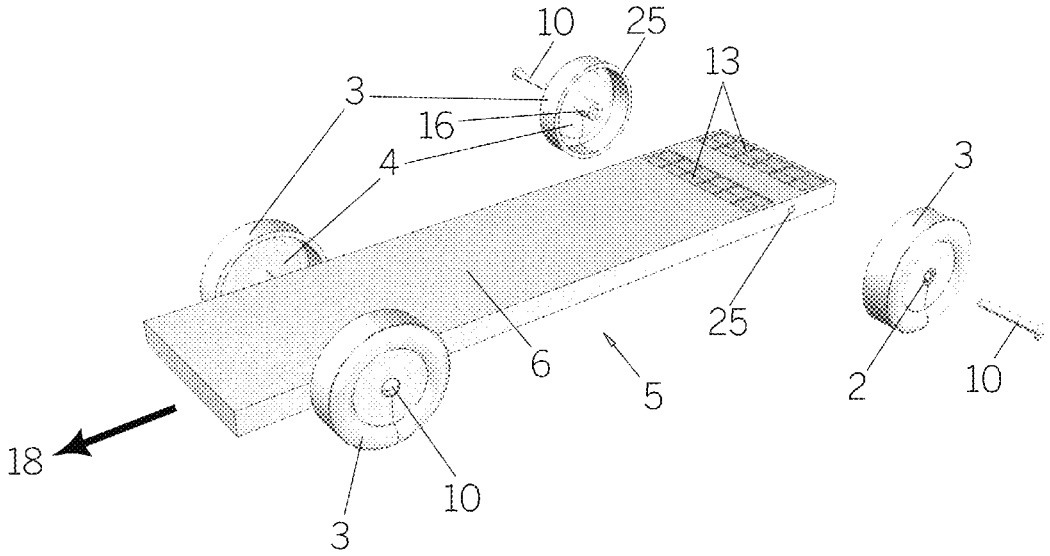
FIG. 2 shows an exploded view of a traditional gravity powered model car
Figure 3:
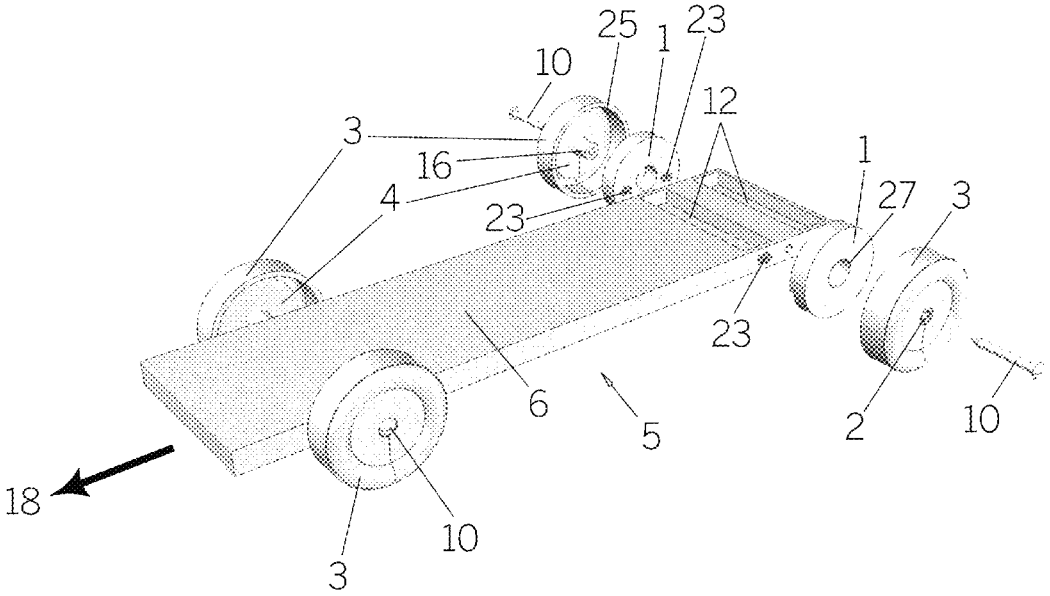
FIG. 3 is an exploded view of a gravity powered model car with a side-weighting system.

FIG. 2 shows an exploded view of a typical gravity powered model car 5 partially assembled wherein the currently known and or traditional weighting system is used. FIG. 3 shows cavities 12 which are carved into the rear of car 6. Tungsten cubes 13 are placed within these cavities 12 to bring the car to the maximum allowable weight. Two (2) rows of six (6) tungsten cubes 13 are squeezed behind the rear axle-line 7. Typically, each cube 13 measures 0.25 in×0.25×0.25. There are also two (2) rows of six (6) cubes 13 placed inside cavities 12 directly in front and behind rear axle-line 7 (as identified in FIG. 5). The arrow 18 provided in the figures indicates the direction of travel 18. Carving cavities 12 into the body 6 is often considered one of the more difficult aspects of making a car. The axle 10 goes through the wheel bore 2 of a typical wheel and is inserted into the axle hole 25. The axle hole 25 is a hole drilled into the body 6. The axle 10 with wheel 3 is inserted into the axle hole 25 but not pressed into the axle hole 25 so far as to not let the wheel 3 spin.

FIG. 3 shows an exploded view of a gravity powered model car with the side-weight system. The axle 10 is a nail that goes through the wheel bore 2, and inserted into the body 6 of car 5. The wheel 3 can spin freely upon this fixed axle 10 and around and inside the side-weight 1. The wheel 3 is typically an injection molded piece of polystyrene that has a void 4. Some of these wheels are made by the brand names Boys Scouts of America (BSA) 3, Pinecar and Maximum Velocity, etc. They are commonly made to measure approximately 1.18 in based on the diameter. The side-weights 1 can be made from tungsten or lead and also other materials such as steel, brass, molybdenum, ceramic, glass, plastic, etc. In this drawing a version of the side weights 1 the car 5 by means of using an adhesive 23. It is necessary to attach the side-weights 1 so that there is clearance between the outer diameter 26 and the under tread 22 as well as clearance between the inner diameter 27 of the weight and the inner hub 16 as can be seen in FIG. 1*b*.

The weight cavities 12 are now left largely vacant to be used to shift tungsten cubes 13 or other weighted material left to right on the car 5 inside the cavities 12. As few as 9 tungsten cubes 13 may be needed to bring the car to the maximum 5 oz limit. This leaves a lot of space within the cavities 12 to move these tungsten cubes 13 as the cavities 12 will normally fit 24 cubes 13.

Traditionally builders have moved weight forward of the cavities 12 in order to bias the weight of the car 5 from left to right. This gives up some of the potential energy of the car as the weight starts lower off the ground as it sits on a track 9 at the start of the race. The arrow 18 is used to show the direction of travel of the car.

FIG. 4 shows an exploded view of a car using the side-weight 1 system. In this drawing the side-weights 1 are attached to the wood body 6 of the car by means of clearance holes 21 through the weights, and screws 28 that hold the side-weight 1 firmly to the car 5. Adhesive 23 is an alternate method of attaching the side-weight 1 to the body 6. Using a tool (not shown) to align the wheel 3 with the side-weight 1 the inner hub 16 of the wheel and the inner diameter 27 of the side-weight 1 will not contact each other. Similarly, the outer diameter 26 of the weight 1 will not make contact with the under tread 22 of the wheel 3.

FIG. 5 is a perspective view showing a fully assembled gravity powered model car 5 with side-weights 1 attached sitting on a Pinewood Derby track 8. The guide rail 8 is the means by which car 5 is able to keep in a relatively straight line, and also keep it from colliding with other cars, or flying off track 9. This side-weight system allows for many benefits compared to traditional weighting methods.

In this drawing a portion of a track 9 and a guide rail 8 is shown. The wheels 3 of a car straddle the guide rail 8 on a track 9 and keep the car from colliding with other cars and keep the car 5 from flying off the track 9.

- A car fitted with side-weights 1 has a lower rotational moment from front to back over traditional weighting methods, which allows it to preserve more energy as it passes through transition 14.
- The moment of inertia of a car fitted with side-weights 1 is increased from side to side over traditional methods which keeps it from rocking back and forth on its rear wheels 3, preserving energy.
- With side-weights 1 inside the wheel voids 4, it is much easier to fit 2 oz of weight behind the rear axle-line 7 while keeping a slim profile 17.
- In an embodiment of the invention 2.6 oz of the 4 oz that need to be added to the body 6 can fit within the wheel voids 4 of a wheel 3. This allows the builder more design freedom as the weight 1 is attached only to the side of the body 6 of the car 5 and is not touching the wheels 3.
- The side-weights 1 largely close off the wheel void 4 from air traveling past the car as it travels down the track 9. These side weights must maintain clearance space and never make contact with the wheel 3 or axle 10.

Figure 6:
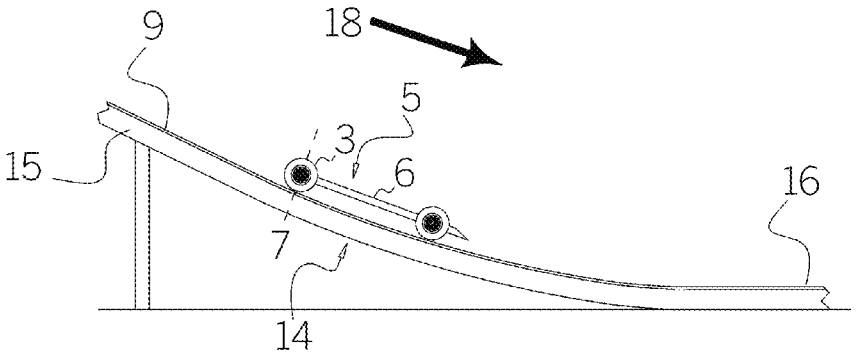
FIG. 6 is a side view of a gravity powered model car on a typical track as considered herein.

FIG. 6 shows a side view of a gravity powered model car 5 on the transition 14 of track 9 with an incline that reaches 48 in high (not pictured). The radius of the transition 14 is often 48 in. The straight portion 9 before the transition 14 is about 7 ft long. The flat portion 16 after the transition 14 is about 35 ft long. The arrow provided in the figure indicates the car's direction of travel 18.

Using the side-weight system a builder is able to fit 2.6 oz of weight encircling the rear axles 10. This setup allows the builder to keep the weight tightly focused along the axle line 7 FIG. 5 which creates a decreased moment of inertia at the transition 14 of a typical track 9.

Figure 7:
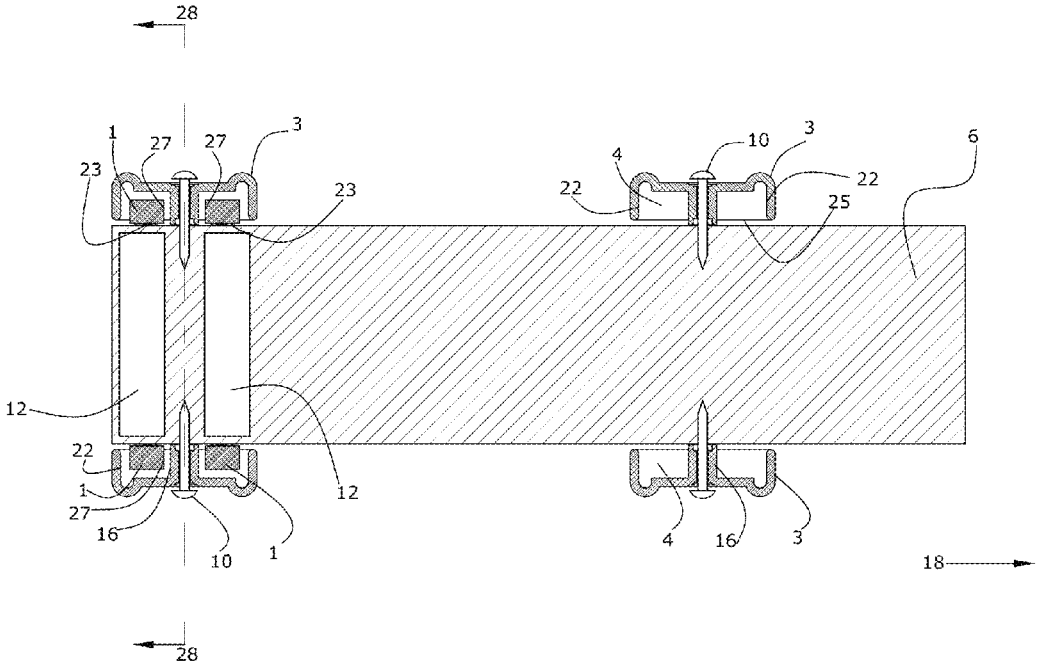
FIG. 7 is a sectional view through the horizontal cutting plane 29 of a gravity powered car.
Figure 8:
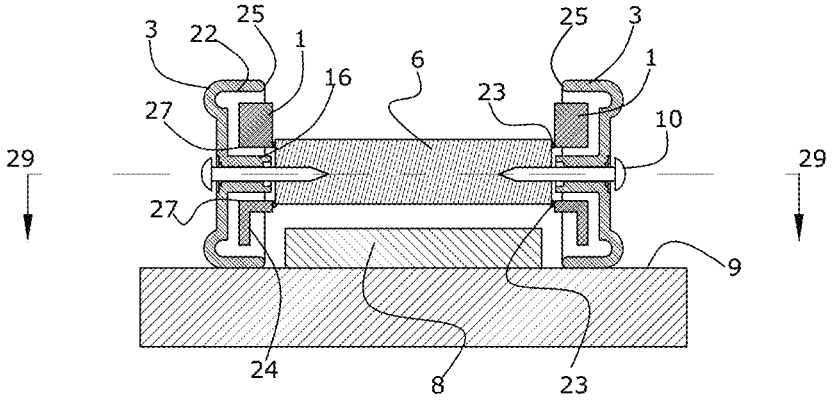
FIG. 8 is a vertical cross sectional view through the rear axle plane 28 as seen in FIG. 7.

FIG. 7 is a sectional view through the horizontal cutting plane 29, as seen in FIG. 8, of a gravity powered car 5. From this cross sectional view one can see the way that side-weights attach to the wood body 6 of a gravity powered car 5 without touching any part of the wheel 3 or the axle 10.

Adhesive 23 is applied between the body 5 and side-weight 1 so that the weight 1, occupies the wheel void 4 while maintaining a clearance on the inside of the wheel 3. Weight pockets 12 are also shown in this section view. A builder has this amount of room to shift tungsten cubes 13 to tune the car 6 and bring the car 6 to the maximum allowable weight.

Normally these cavities 12 would be completely filled with tungsten cubes 13 but now the builder has some room to play with as the car 5 is near maximum weight with less than half of the cavities 12 filled with tungsten cubes 13. The direction of the car 18 is indicated in this drawing.

FIG. 8 is a vertical cross sectional view through the rear axle plane 28 as seen in FIG. 7. In this view one also see the cross section of a track 9 and guide rail 8. The means of attaching the side-weight 1 to the body 6 is shown by means of an adhesive 23. From this vantage point one can see the reason why a recess 24 may be necessary in most embodiments of the invention. The side-weight 1 should not protrude beyond the inner edge 25 of the wheel 3 on the lower hemisphere, or it may contact the guide rail 8 during a race.

While the foregoing disclosure of the invention enables one of ordinary skill to make and use this invention, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

Having thus described the invention, what is claimed as new and desired to be secured by Letters Patent is:

1. A model car weight system that can be used for increasing the potential energy and stability of gravity powered model cars that comprises:

a car body and at least two wheels connected to said car body by corresponding axels about a rear axle line of said car body, the connection of which defines a spacing or void between the wheels and the car body; and, at least one weighted material directly connected to the car body disposed within said spacing or void.

2. The model car weight system of claim 1 whereby the weighted material is directly connected to the car by an adhesive.

3. The model car weight system of claim 1 whereby the weighted material is directly connected to the car by fasteners selected from the group consisting of a screw, a nail, a staple or combinations thereof.

4. The model car weight system of claim 1 whereby the weighted material substantially occupies the defined spacing or void, thereby reducing drag.

5. The model car weight system of claim 4 whereby a portion of the weighted material is recessed or etched according to user need.

6. The model car weight system of claim 4 whereby a portion of the weighted material is recessed or etched to promote visibility of the car for inspection.

7. The model car weight system of claim 1 whereby the weighted material is selected from the group of materials consisting of tungsten, lead, steel, brass, molybdenum, ceramic, glass, plastic and combinations thereof.

* * * * *